US007297671B2

(12) United States Patent
Thankachan et al.

(10) Patent No.: US 7,297,671 B2
(45) Date of Patent: Nov. 20, 2007

(54) ALKOXY SURFACTANTS HAVING INCREASED CLOUD POINTS AND METHODS OF MAKING THE SAME

(75) Inventors: Chacko Thankachan, West Bloomfield, MI (US); Brian J. Betke, Riverview, MI (US)

(73) Assignee: BASF Corporation, Florham Park, NJ (US)

( * ) Notice: Subject to any disclaimer, the term of this patent is extended or adjusted under 35 U.S.C. 154(b) by 290 days.

(21) Appl. No.: 10/988,844

(22) Filed: Nov. 16, 2004

(65) Prior Publication Data

US 2006/0105934 A1 May 18, 2006

(51) Int. Cl.

| | |
|---|---|
| ***C11D 1/72*** | (2006.01) |
| ***C11D 1/722*** | (2006.01) |
| ***C11D 3/02*** | (2006.01) |
| ***C11D 7/06*** | (2006.01) |

(52) U.S. Cl. ..... 510/360; 510/342; 510/413; 510/421; 510/437; 510/475; 510/535

(58) Field of Classification Search ..... 510/342, 510/360, 413, 421, 437, 475, 535
See application file for complete search history.

(56) References Cited

U.S. PATENT DOCUMENTS

| | | | | |
|---|---|---|---|---|
| 4,110,268 A | | 8/1978 | Longley et al. | |
| 4,118,326 A | | 10/1978 | Login | |
| 4,212,760 A | * | 7/1980 | Baur et al. | 510/339 |
| 4,430,490 A | | 2/1984 | Doerge | |
| 5,503,764 A | * | 4/1996 | Murch et al. | 510/111 |
| 6,191,315 B1 | * | 2/2001 | Thankachan et al. | 568/621 |

FOREIGN PATENT DOCUMENTS

| | | |
|---|---|---|
| EP | 0 677 578 A1 | 10/1995 |
| EP | 1 028 138 A2 | 8/2000 |
| EP | 1 028 138 A3 | 8/2000 |

OTHER PUBLICATIONS

Otten, Jay G. et al, "Anionic Hydrotropes for Industrial and Institutional Rinse Aids," JAOCS, vol. 63, No. 8 (Aug. 1986), pp. 1078-1081.

Pandya, Ketan et al, "Effect of Additives on the Clouding Behavior of an Ethylene Oxide-Propylene Oxide Block Copolymer in Aqueous Solution," J.M.S.—Pure Appln. Chem., A30(1), pp. 1-18 (1993), Jun. 7, 1993.

Surfactants and Polyalkylene Glycols, Specialty Chemicals by BASF, pp. 1-51, no date given.

* cited by examiner

*Primary Examiner*—Brian Mruk
(74) *Attorney, Agent, or Firm*—Fernando A. Borrego

(57) ABSTRACT

Neutralizing a surfactant which is comprised of an alkaline-catalyzed reaction product between a monomeric or polymeric alcohol having at least one active hydrogen group and an alkylene oxide with a fatty acid allows the cloud point of the surfactant to be adjusted.

18 Claims, No Drawings

ALKOXY SURFACTANTS HAVING INCREASED CLOUD POINTS AND METHODS OF MAKING THE SAME

FIELD OF THE INVENTION

The present invention relates generally to the field of surfactants and methods of making the same. In particularly preferred form, the present invention relates to nonionic surfactants having increased cloud points and to methods of making the same.

BACKGROUND AND SUMMARY OF THE INVENTION

The clouding behavior of surfactants in water with increasing temperature has several practical applications. For example, the defoaming action of surfactants becomes effective just above their cloud point. See Otten et al, "Anionic Hydrotropes for Industrial and Institutional Rinse Aids", JAOCS; 63(8); 1078; 1986 (the entire content of which is incorporated expressly hereinto by reference). An end user will therefore select a particular surfactant for specific problem solving abilities such as wetting, detergency, foaming, defoaming and the like. In cleaning applications such as machine dish washing, the properties noted above are important. Since the water temperature in dish washing applications is relatively high, the surfactant selected often cannot meet all of the desired performance criteria. As a result, additives are typically included with the surfactant to achieve the desired solubilization. However, often times, when all other properties of the surfactant are in agreement for a specific application, often the surfactant's cloud point is too low. While the cloud point can be engineered by altering the surfactant's chemical structure, such structural alteration usually is accompanied by a change in one of its other properties thereby making it no longer useful for the intended application.

Recently, it has been suggested that certain electrolytes may be added so as to adjust the cloud point of a block copolymer surfactant comprised of an ethylene oxide (EO) and propylene oxide (PO) units. Pandya et al, "Effect of Additives on the Clouding Behavior of an Ethylene Oxide-Propylene Oxide Block copolymer in Aqueous Solution"; J.M.S-Pure Appl. Chem; A30(1); 1; 1993 (the entire content of which is expressly incorporated hereinto by reference). However, the technique described in this paper involves the addition of foreign materials often adding extra cost and unwanted interferences in the surfactant's performance.

Polyether polyol surfactants are typically prepared by the reaction of monomeric or polymeric initiators containing one or more active hydrogen-containing group(s), such as OH, $NH_2$, NH, $CO_2H$ and the like, with alkylene oxides. The alkylene oxide reactions with the active hydrogen-containing compounds are catalyzed with alkaline catalysts such as potassium hydroxide and sodium hydroxide. At the end of the reaction, the catalyst is deactivated by either removing the catalyst physically from the resulting reactant mixture or by adding an acid, such as acetic acid, phosphoric acid, sulfuric acid and the like, in order to neutralize the catalyst. The most cost-effective way of deactivating the alkaline catalyst is by neutralizing the catalyst with an acid and leaving the resulting salt physically in the polyether polyol reaction product.

It has now been surprisingly discovered that, by neutralizing a surfactant which is the alkaline-catalyzed reaction product between a monomeric or polymeric compound (initiator) having at least one active hydrogen group and an alkylene oxide with a fatty acid, the cloud point of the surfactant may be raised as compared to otherwise identical surfactants which have not been neutralized (i.e., non-neutralized surfactants) and/or otherwise identical surfactants that have been neutralized with conventional non-fatty acids, such as acetic acid, phosphoric acid, sulfuric acid and the like.

These and other aspects and advantages will become more apparent after careful consideration is given to the following detailed description of the preferred exemplary embodiments thereof.

DETAILED DESCRIPTION OF THE INVENTION

The preferred surfactants employed in the practice of the present invention include the alkaline-catalyzed reaction products between a monomeric or polymeric initiator having at least one active hydrogen-containing group with an alkylene oxide (e.g., polyether polyols). Especially preferred surfactants include at least one of an alcohol alkoxylates and block copolymers of ethylene oxide (EO) and propylene oxide (PO). The preferred alcohol alkoxylates have the general formula:

$$R1\text{-}(EO)_m\text{-}(PO)_n\text{-}OH,$$

where R1 is a C6-C30 alkyl, alkenyl, alicyclic or aromatic hydrocarbon, and m and n are each, independent of one another, numbers from 0 to 100, provided that the total of m+n is 2 to 100. The alcohol alkoxylates most preferably include an alcohol chain having from 1 to 25 carbon atoms and most preferably include a linear alkyl alcohol alkoxylates and alkylphenol alkoxylates (e.g., dodecyl alcohol ethoxylates, tridecyl alcohol ethoxylates, nonylphenol ethoxylates, octylphenol ethoxylates and the like). Suitable alcohol alkoxylate surfactants are commercially available from BASF Corporation under the trademarks PLURAFAC® and ICONOL™.

The preferred block copolymers of EO and PO units will typically have a number average molecular weight of from 500 to 15,000, preferably between 1,000 to 10,000. Suitable block copolymers of EO and PO are commercially available from BASF Corporation under the registered trademark TETRONIC®.

Virtually any saturated or unsaturated fatty acid may be employed in the practice of this invention. Preferably, the fatty acid will have at least 8 carbon atoms in its chain. Most preferably, C8 up to C24 fatty acids are employed. Specific examples of preferred fatty acids include caprylic acid, capric acid, lauric acid, myristic acid, palmitic acid, palmitoleic acid, stearic acid, oleic acid, vaccenic acid, linoleic acid, arachidic acid, behenic acid, erucic acid and lignoceric acid. In addition, the fatty acids may be supplied by natural sources such as tall oil, coconut oil, palm kernel oil, animal fats, olive oil, butter fat, corn oil linseed oil, peanut oil fish oil, rapeseed oil and the like.

The fatty acid is employed in amounts sufficient to neutralize the alkaline catalysts (typically potassium hydroxide, sodium hydroxide or the like) employed in the reaction of monomeric or polymeric alcohols containing one or more active hydrogen-containing group(s) with alkylene oxides. By the term "neutralize" is meant that the resulting surfactant following the addition of the fatty acid has a pH of between about 5.5 to about 8.5, more preferably about 7.0+/−0.9. The fatty acid is preferably employed in an amount which increases the cloud point temperature of the surfactant by between about 2° C. to about 50° C., more preferably, between about 5° C. to about 35° C., as compared to the unneutralized surfactant and/or the surfactant which has been neutralized conventionally (i.e., neutralized with non-fatty acids such as acetic acid, phosphoric acid, sulfuric acid and the like). It should of course be understood that the cloud point temperature increase achieved by the present invention is dependent upon the particular surfactant that is neutralized with the fatty acid. That is, some surfactants will experience a greater cloud point temperature increase as compared to other surfactants. Most preferably, the fatty acid will be employed in amounts sufficient to neutralize the alkaline catalyst used in the production of the surfactant to a pH range of between about 6.5 to about 8.5.

The present invention will be further described by reference to the following non-limiting examples.

The following nonionic surfactants identified as surfactants S1-S5 commercially available from BASF Corporation were employed in the following Examples:

S1=TETRONIC® 90R4: A tetrafunctional block ethylene-oxide-propylene oxide copolymer with terminal secondary hydroxyl groups.

S2=PLURAFAC® D-25: A monofunctional fatty alcohol onto which is added propylene oxide and ethylene oxide.

S3=PLURAFAC® RA30: A polyoxyethylene-polyoxypropylene block monool a mixture of fatty monohydroxyl alcohols, terminated with oxypropylene units, having an OH number of about 90.

S4=PLURAFAC® RA40: A polyoxyethylene-polyoxypropylene block monool a mixture of fatty monohydroxyl alcohols, terminated with oxypropylene units, having an OH number of about 69.

S5=ICONOL™ OP-10: A water-soluble nonionic surfactant composed of a 10-mole adduct of octylphenol.

S6=ICONOL™ NP-9: A water-soluble nonionic surfactant composed of a 9-mole adduct of nonylphenol.

A "cloud point" is the temperature at which a surfactant solution becomes cloudy. The cloud points were determined on the samples listed in examples S1-S6 as outlined below. The method was applicable to both neutralized product and in-process samples (unneutralized). The process was terminated often by checking the cloud point of the in-process sample (unneutralized) to the set commercial specification of the product neutralized with conventional acids or after removal of the catalyst. The determined cloud points of the unneutralized process samples were the same for the neutralized commercial samples.

Cloud points were determined by forcing a surfactant solution of known concentration in water or water solvent mixture to cloud by adjusting its temperature. The solution temperature at which the clouding solution becomes clear was recorded was determined to be the cloud point for the surfactant.

EXAMPLE 1

Unneutralized samples of nonionic surfactants identified in Table 1 were neutralized with oleic acid and tall oil fatty acid. The cloud points of the samples were measured before and after neutralization. The results appear in Table 1.

TABLE 1

| | Specifications* | | Measured** | | Resultant Change | |
|---|---|---|---|---|---|---|
| Surfactant | pH | Cloud Pt. ° C. | Cloud Pt. ° C. | Fatty Acid | pH | Cloud Pt. ° C. |
| S1 | 7.5–9.5 | 39–44 | 42.5 | Oleic | 7.1 | 45.5 |
| S2 | 5–6.5 | 52–62 | 55.5 | " | 7.5 | 69.7 |
| S3 | " | 35–39 | 38.2 | " | 7.8 | 52.0 |
| S4 | " | 22–27 | 26.3 | " | 7.9 | 31.8 |
| S5 | 6–7.5 | 63–67 | 64.9 | " | 7.5 | 80.2 |
| S1 | 7.5–9.5 | 39–44 | 42.5 | Tall Oil FA | 7.3 | 45.4 |
| S2 | 5–6.5 | 52–62 | 55.5 | " | 7.6 | 67.9 |
| S3 | " | 35–39 | 38.2 | " | 7.9 | 50.5 |
| S4 | " | 22–27 | 26.3 | " | 7.9 | 33.5 |
| S5 | 6–7.5 | 63–67 | 64.9 | " | 7.9 | 77.0 |

*All cloud points were measured on a 1% aqueous solution of the surfactant. The values given are the specification range for products neutralized with acetic acid or phosphoric acid.
**These cloud points were measured using the unneutralized surfactants.

The data show that the addition of oleic acid to each of the nonionic surfactants increased their respective cloud points.

EXAMPLE 2

Unneutralized samples of surfactant S6 (ICONOL™ NP-9) was neutralized with several fatty acids identified below in Table 2. The pH and 1% aqueous cloud points after neutralization were measured with the results being noted in Table 2 below.

TABLE 2

| | Specifications* | | Measured** | | Resultant Change | |
|---|---|---|---|---|---|---|
| Surfactant | pH | Cloud Pt. ° C. | Cloud Pt. ° C. | Fatty Acid | pH | Cloud Pt. ° C. |
| S6 | 5–8 | 52–56 | 52.2 | Oleic | 6.9 | 87.2 |
| " | " | " | " | Capric | 6.2 | 61.4 |

TABLE 2-continued

| | Specifications* | | Measured** | | Resultant Change | |
|---|---|---|---|---|---|---|
| Surfactant | pH | Cloud Pt. ° C. | Cloud Pt. ° C. | Fatty Acid | pH | Cloud Pt. ° C. |
| " | " | " | " | Palmitic | 6.6 | 90.5 |
| " | " | " | " | Coconut FA | 6.3 | 67.1 |

*All cloud points were measured on a 1% aqueous solution of the surfactant. The values given are the specification range for products neutralized with acetic acid or phosphoric acid.
**These cloud points were measured using the unneutralized surfactants.

It was observed that neutralization with fatty acids increased the cloud point of the nonionic surfactant.

EXAMPLE 3

Example 2 was repeated except that blends of acetic acid and oleic acid were employed to neutralize an unneutralized sample of surfactant S6. The results appear in Table 3 below.

TABLE 3

| | Resultant Changes | |
|---|---|---|
| Surfactant | pH | Cloud Pt. ° C. |
| S6 neutralized with 5:1 oleic acid:acetic acid by weight | 5.8 | 55.1 |
| S6 neutralized with 17.5:1 oleic acid:acetic acid by weight | 6.5 | 73.5 |

The data above reveal that higher ratios of the fatty acid are needed in order to achieve a cloud point increase.

EXAMPLE 4 (COMPARATIVE)

Various amounts of oleic acid were added to a commercial sample (already neutralized with acetic acid) of surfactant S6. No increase in cloud point was observed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A surfactant composition comprising:
an alkaline-catalyzed alkoxy surfactant, and
a salt of:
an alkaline catalyst, and
a straight-chain fatty acid having from 8 to 24 carbon atoms,
wherein the pH of said surfactant composition is about 7.0 +/−0.9.

2. The surfactant composition of claim 1 wherein said alkaline-catalyzed alkoxy surfactant comprises the reaction product of a monomeric or polymeric alcohol having at least one active hydrogen-containing group and an alkylene oxide in the presence of said alkaline catalyst.

3. The surfactant composition of claim 2 wherein said active hydrogen-containing group is at least one selected from the group consisting of OH, $NH_2$, NH, and $CO_2H$.

4. The surfactant composition of claim 1 wherein said alkaline-catalyzed alkoxy surfactant comprises at least one of an alcohol alkoxylate and a block copolymer comprised of ethylene oxide and propylene oxide units.

5. The surfactant composition of claim 1 wherein said alkaline-catalyzed alkoxy surfactant has the formula:

$$R1\text{-}(EO)_m\text{-}(PO)_n\text{-}OH$$

where R1 is a C6-C30 alkyl, alkenyl, alicyclic, or aromatic hydrocarbon, and m and n are each independent of one another numbers from 0 to 100 provided that the total of m+n is 2 to 100.

6. The surfactant composition of claim 1, wherein said alkaline-catalyzed alkoxy surfactant comprises a block copolymer comprised of ethylene oxide and propylene oxide units having a number average molecular weight of from 500 to 15,000.

7. The surfactant composition as in claim 1, wherein said straight-chain fatty acid is at least one selected from the group consisting of caprylic acid, capric acid, lauric acid, myristic acid, palmitic acid, palmitoleic acid, stearic acid, oleic acid, vaccenic acid, linoleic acid, arachidic acid, behenic acid, erucic acid, and lignoceric acid.

8. The surfactant composition as in claim 6, wherein said straight-chain fatty acid is derived from at least one of tall oil, coconut oil, palm kernel oil, animal fats, olive oil, butter fat, corn oil, linseed oil, peanut oil, fish oil, and rapeseed oil.

9. The surfactant composition as in claim 1, wherein the cloud point temperature of said surfactant is increased by between about 2° C. to about 50° C. as compared to the unneutralized surfactant and/or a surfactant which has been neutralized with non-straight-chain fatty acids.

10. The surfactant composition as in claim 9 wherein the cloud point temperature of said surfactant composition is increased by between about 5° C. to about 35° C.

11. The surfactant of claim 1 wherein said alkaline-catalyzed alkoxy surfactant comprises at least one of an alcohol alkoxylate of ethylene oxide/propylene oxide or a block copolymer comprised of ethylene oxide and/or propylene oxide units.

12. A method of adjusting the cloud point temperature of a surfactant composition including an alkaline-catalyzed alkoxy surfactant formed in the presence of an alkaline catalyst comprising adding to the surfactant composition an amount of a straight-chain fatty acid having from 8 to 24 carbon atoms sufficient to neutralize the alkaline catalyst and achieve a pH of the surfactant composition of about 7.0 +/−0.9 and thereby raise the cloud point temperature of the surfactant composition.

13. The method of claim 12 wherein the alkaline-catalyzed alkoxy surfactant comprises the reaction product of a monomeric or polymeric alcohol having at least one OH group and an alkylene oxide in the presence of the alkaline catalyst.

14. The method of claim 12 wherein the alkaline-catalyzed alkoxy surfactant comprises at least one of an alcohol alkoxylate of ethylene oxide/propylene oxide or a block copolymer comprised of ethylene oxide and/or propylene oxide units.

15. The method of claim 12 wherein the alkaline-catalyzed alkoxy surfactant has the formula:

$$R1\text{-}(EO)_{m\text{-}(PO)n}\text{-}OH$$

where R1 is a C6-C30 alkyl, alkenyl, alicyclic, or aromatic hydrocarbon, and m and n are each independent of one another numbers from 0 to 100, provided that the total of m+n is 2 to 100.

16. The method of claim 12, wherein the alkaline-catalyzed alkoxy surfactant comprises a block copolymer comprised of ethylene oxide and propylene oxide units having a number average molecular weight of from 500 to 15,000.

17. The method as in claim 12 wherein the straight-chain fatty acid is at least one selected from the group consisting of caprylic acid, capric acid, lauric acid, myristic acid, palmitic acid, palmitoleic acid, stearic acid, oleic acid, vaccenic acid, linoleic acid, arachidic acid, behenic acid, erucic acid, and lignoceric acid.

18. The method as in claim 12 wherein the straight-chain fatty acid is derived from at least one of tall oil, coconut oil, palm kernel oil, animal fats, olive oil, butter fat, corn oil, linseed oil, peanut oil, fish oil, and rapeseed oil.

* * * * *